US008322286B2

(12) United States Patent
Toreheim et al.

(10) Patent No.: US 8,322,286 B2
(45) Date of Patent: Dec. 4, 2012

(54) CARTRIDGE CASE AND A ROUND COMPRISING SUCH A CARTRIDGE CASE

(75) Inventors: Jon Toreheim, Karlstad (SE); Alf Prytz, Karlskoga (SE); Geron Karlsson, Karlskoga (SE)

(73) Assignee: SAAB AB, Linköping (SE)

( * ) Notice: Subject to any disclaimer, the term of this patent is extended or adjusted under 35 U.S.C. 154(b) by 68 days.

(21) Appl. No.: 13/123,253

(22) PCT Filed: Oct. 10, 2008

(86) PCT No.: PCT/SE2008/000550
§ 371 (c)(1),
(2), (4) Date: Apr. 8, 2011

(87) PCT Pub. No.: WO2010/041988
PCT Pub. Date: Apr. 15, 2010

(65) Prior Publication Data

US 2011/0192312 A1 Aug. 11, 2011

(51) Int. Cl.
*F42B 5/26* (2006.01)

(52) U.S. Cl. ..... 102/469

(58) Field of Classification Search ..... 102/469–472, 102/377
See application file for complete search history.

(56) References Cited

U.S. PATENT DOCUMENTS

| | | | | |
|---|---|---|---|---|
| 5,421,264 | A * | 6/1995 | Petrick | 102/443 |
| 5,712,445 | A * | 1/1998 | Kassuelke et al. | 102/288 |
| 6,321,656 | B1 | 11/2001 | Johnson | |
| 6,581,522 | B1 * | 6/2003 | Julien et al. | 102/431 |
| 2004/0244358 | A1 | 12/2004 | Prytz | |
| 2006/0054046 | A1 | 3/2006 | Cook et al. | |
| 2011/0192313 | A1 * | 8/2011 | Toreheim et al. | 102/469 |

FOREIGN PATENT DOCUMENTS

FR 2686410 A1 7/1993

OTHER PUBLICATIONS

PCT/ISA/210—International Search Report—May 18, 2009.
PCT/ISA/237—Written Opinion of the International Searching Authority—May 18, 2009.

* cited by examiner

*Primary Examiner* — Michael David
(74) *Attorney, Agent, or Firm* — Venable LLP; Eric J. Franklin

(57) ABSTRACT

A cartridge case intended for explosive materials. A releasable base plate is provided in a bottom section of the cartridge case. A base plate locking device includes a temperature dependent shape memory material. A space is provided partly in the bottom section of the cartridge case and partly in the base plate of the cartridge case defining a motion path inclined backwards for the shape memory material to follow when its passes a temperature such that the shape memory struggles to resume a former shape, resulting in that the base plate is unlocked from the bottom section of the cartridge case and released. A round of ammunition including the cartridge case.

8 Claims, 3 Drawing Sheets

CARTRIDGE CASE AND A ROUND COMPRISING SUCH A CARTRIDGE CASE

CROSS-REFERENCE TO RELATED APPLICATIONS

The application is the national phase under 35 U.S.C §of PCT/SE2008/000550 field 10 Oct. 2008.

FIELD OF THE INVENTION

The present invention relates to a cartridge case intended for explosive materials comprising a releasable base plate provided in a bottom section of the cartridge case and a base plate locking device comprising a temperature dependent shape memory material. The invention also relates to a round of ammunition comprising such a cartridge case.

BACKGROUND OF THE INVENTION

When constructing low sensitive weapon systems, Insensitive Munitions, abbreviated IM, is an area to be considered and where to take care of the problems arising when the weapon system is subjected to heating. It is very important especially for personal safety reasons but also for transport classification reasons and for IM status reasons that a weapon system not can be brought into violent reactions when it is subjected to external stimuli.

A problem in connection to the above is that enclosed explosive materials subjected to heating will result in that the explosive materials are set to fire and burned. In this connection stronger enclosures result in more violent reactions.

An example of a cartridge case according to the first paragraph is previously known from FR 2 686 410 A1. The disclosed cartridge case comprises a shape memory material in the shape of a ring considerably elongated perpendicular to its radius located in a space between the base plate and the bottom section. Under normal temperature conditions the shape memory material is positioned in the space to lock the base plate to the bottom section of the cartridge case. In case of a temperature increase such that the temperature exceeds a predefined critical value, the shape memory material returns to a former shape positioning the shape memory material more inwards in the space resulting in that the base plate is unblocked. The arrangement of the shape memory material suffers from some problems. One problem is that the space between the base plate and the bottom section is voluminous to be able to house the considerably elongated shape memory material both in blocked and unblocked positions. This fact inter alia renders a distinct positioning of the shape memory material difficult in blocked and unblocked positions. There is also a risk that the movement of the shape memory material between blocked and unblocked positions is indistinct inter alia due to the elongated and cornered shape. Furthermore, when the content of the cartridge case is subjected to heating the content is likely to expand. This results in that there is a risk that the shape memory material is secured between the base plate and the bottom section before a critical temperature for unblocking has been reached. This may result in that the base plate not is released at all or that the releasing of the base plate is unacceptably delayed.

SUMMARY OF THE INVENTION

The object of the invention is to obtain a cartridge case that is more reliable in its operation when subjected to heating and that at the same time requires minimal of adaption to cartridges on the market. The object is also to obtain a round of ammunition comprising such a cartridge case.

The object of the invention is obtain by a cartridge case characterized in that a space is provided partly in the bottom section of the cartridge case and partly in the base plate of the cartridge case defining a motion path inclined backwards for the shape memory material to follow when it at a temperature increase passes a temperature such that the shape memory struggles to resume a former shape, resulting in that the base plate is unlocked from the bottom section of the cartridge case and released. By means of a well defined motion path an opening in the cartridge case is obtained in a reliable way admitting content of the cartridge case to be released. An opening in the cartridge case is created great enough to relieve the over pressure arising when the explosive materials are transformed.

According to a favourable development of the cartridge case the motion path has an inclination backwards within an angular range of 30 to 60 degrees and preferably about 45 degrees relative to the symmetry axis of the cartridge case. Such an inclined motion path has shown to offer a reliable opening procedure controlled by the motion path and avoids unintended blocking of the opening procedure. A well defined opening for the overpressure in the cartridge case is obtained at the bottom section of the cartridge case at the same time as the base plate leaves the cartridge case.

According to another favourable embodiment of the cartridge case the space defining a motion path is delimited in the bottom section by an outer support ring and an inner support ring. The introduction of such support rings contributes to a well defined motion path and enables use of a standardized cartridge case.

According to still another favourable embodiment the shape memory material is designed as a circular ring. Such a ring is easy to put in position when assembling the cartridge case and offers a symmetric locking of the bottom plate. Preferably the shape memory material has an essentially circular cross section. If the shape memory material is to transform to a former shape, a circular cross section of the ring is a favourable shape that facilitates the movement of the ring from one end of the space to another end of the space along the defined motion path.

A suitable measure of the length of the motion path is designed to be about a doubled measure of a cross section of the shape memory material. This measure is well within a possible transform movement of the shape memory material.

The invention also refers to a round of ammunition comprising a cartridge case as defined above.

BRIEF DESCRIPTION OF THE DRAWINGS

The invention will now be described in more detail by means of exemplified embodiments with reference to the accompanying drawings in which.

DETAILED DESCRIPTION OF EMBODIMENTS OF THE INVENTION

Figure 1:
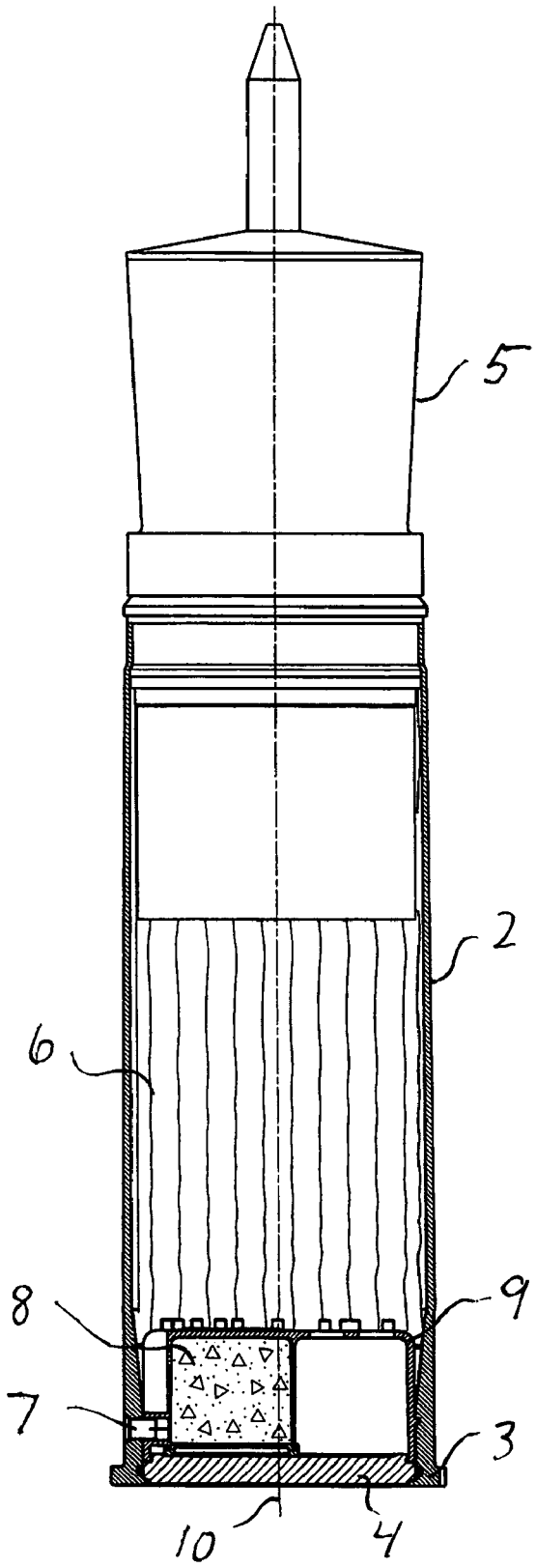
FIG. 1 in a side view and partly sectioned shows a round of ammunition that can be provided with a cartridge case according to the invention.

In FIG. 1 a round of ammunition 1 is shown suitable for base plate release arrangement according to the invention. This round comprises a cartridge case 2 with a bottom section 3 and a base plate 4. The cartridge case houses a projectile 5 driven by propellant 6 that can be in the shape of strip formed double base propellant. Furthermore there is provided a percussion cap 7, an igniter composition 8 and an igniter cap 9. The round of ammunition 1 is symmetrical and has a symmetry axis 10. The projectile comprises explosive materials of known kind and not further discussed here. The operation of the round when activated follows known common principles and will not be further described here but only the safety arrangements preventing harmful explosions when the round is subjected to undesired heating before normal use. This safety arrangement will be described below with reference to FIGS. 2*a*, 2*b*, 2*c* and 3.

Figure 2C:
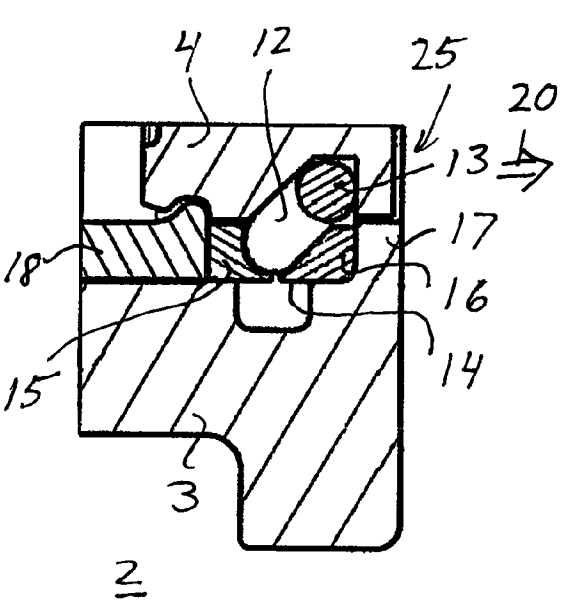
FIGS. 2*a*, 2*b* and 2*c* schematically in a cross section show an example of an embodiment of a cartridge case based upon a movement backwards inwards before unlocking of a base plate has started, FIG. 2*a*, when the unlocking has started to unlock the base plate, FIG. 2*b* and when the base plate has been unlocked from the bottom section of the cartridge case, FIG. 2*c*.
Figure 2B:
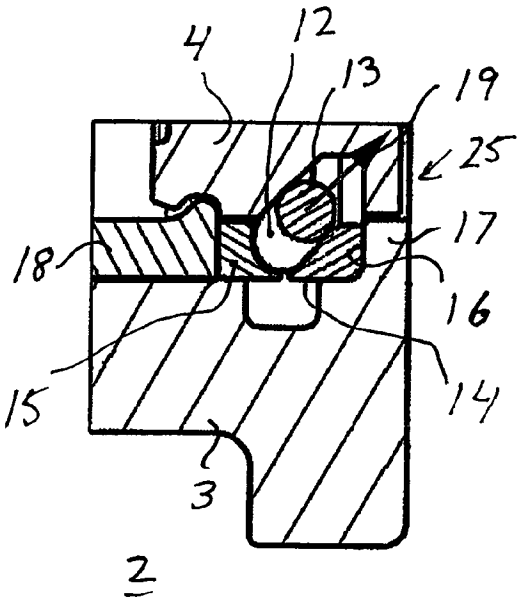
Figure 2A:
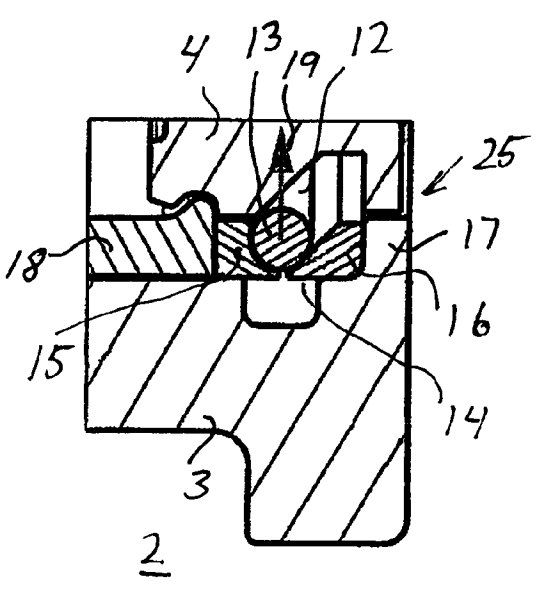

According to FIGS. 2*a*, 2*b* and 2*c*, the bottom section 3 of a cartridge case 2 with a base plate 4 are shown. A base plate locking device 25 comprises a space 12 defining a motion path for a shape memory material 13. The shape memory material 13 is in the shape of a circular ring having a circular cross section. Suitable materials for the ring are shape memory alloys such as copper-zinc-aluminium-nickel, copper-aluminium-nickel or nickel-titanium alloys. Many other compositions are also possible. The space 12 has an extension partly in the bottom section 3 of the cartridge case 2 and partly in the base plate 4. The extension in the bottom section is determined by a recess 14 in the bottom section 3 in cooperation with an inner support ring 15 and an outer supporting ring 16. The recess 14 is delimited in width by a projecting flange 17 and an igniter cap 18.

When a round of ammunition 1 comprising a cartridge case 2 as described in the last paragraph is subjected to heating and the heating passes a resume to former shape temperature of the ring of shape memory material 13, a strong inherent force of the ring struggles to change the shape of the ring as indicated by the arrow 19 at first pointing radially inwards. This results in that the shape memory material 13 leaves the position shown in FIG. 2*a* and follows the motion path defined by the space 12. FIG. 2*b* shows the situation when the shape memory material has left its original locking position but still keeps the base plate 4 locked to the bottom section 3. The force of the shape memory material is now moving the shape memory material 19 as indicated by the arrow 19 directed backwards inwards. Finally the shape memory material 13 reaches the end of the motion path of the space 12 in the base plate 4, see FIG. 2*c*. In this position of the shape memory material 13, the base plate 4 is free to leave the bottom section 3 of the cartridge case 2. An over pressure in the cartridge case 2 can now open up the bottom of the cartridge case 2 by pressing the base plate 4 out of its position backwards as indicated by the arrow 20. This opening up of the cartridge case has an essential effect on the conversion or transform of explosive materials contained in the cartridge resulting in an essentially less violent reaction.

Figure 3:
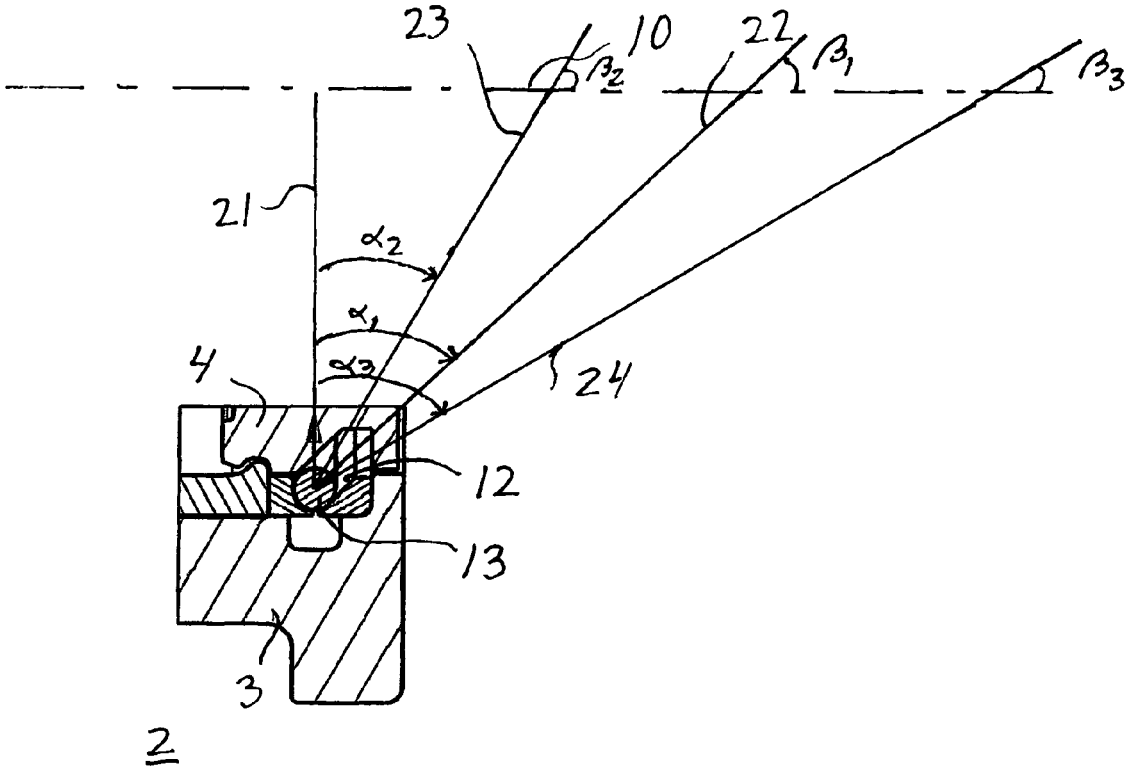
FIG. 3 schematically illustrates examples of inclination angles.

In FIG. 3 it is schematically illustrated what is meant with inclination backwards and denoted with $\beta$. In this figure there is a line 10 showing the symmetry axis of the cartridge case 2. From the centre of the shape memory material (13) four straight lines 21, 22, 23 and 24 are shown. Line 21 is perpendicular to the symmetry axis 10. Line 22 follows the direction of the motion path of the space 12. Lines 23 and 24 indicate other possible directions of motion paths. The angle between lines 10 and 22 is denoted $\beta_1$ and is about 45 degrees. The angle between lines 10 and 23 is denoted $\beta_2$ and is about 60 degrees while the angle between lines 10 and 24 is denoted $\beta_3$ and is about 30 degrees. Corresponding angles $\alpha_1$, $\alpha_2$, $\alpha_3$ have also been indicated relative to the line 21 perpendicular to line 10.

The invention is not limited to the embodiment described above but may be modified within the scope of the invention. For example the motion path shown directed inwards backwards could be directed outwards backwards.

The invention claimed is:

1. A cartridge case intended for explosive materials, comprising:

a releasable base plate provided in a bottom section of the cartridge case, and a base plate locking device comprising a temperature dependent shape memory material, wherein a space is provided partly in the bottom section of the cartridge case and partly in the base plate of the cartridge case defining a motion path inclined backwards for the shape memory material to follow when an increasing temperature of the shape memory material passes a temperature such that the shape memory struggles to resume a former shape, resulting in that the base plate is unlocked from the bottom section of the cartridge case and released.

2. The cartridge case according to claim 1, wherein the motion path has an inclination backwards within an angular range of 30 to 60 degrees relative to the symmetry axis of the cartridge case.

3. The cartridge case according to claim 1, wherein the space defining a motion path is delimited in the bottom section by an outer support ring and an inner support ring.

4. The cartridge case according to claim 1, wherein the shape memory material is designed as a circular ring.

5. The cartridge case according to claim 4, wherein the shape memory material has an essentially circular cross section.

6. The cartridge case according to claim 1, wherein the length of the motion path is designed to be about a doubled measure of a cross section of the shape memory material.

7. The cartridge case according to claim 2, wherein the angular range of the inclination backwards of the motion path is about 45 degrees relative to the symmetry axis of the cartridge case.

8. A round of ammunition, comprising:

a cartridge case comprising a releasable base plate provided in a bottom section of the cartridge case, and a base plate locking device comprising a temperature dependent shape memory material, wherein a space is provided partly in the bottom section of the cartridge case and partly in the base plate of the cartridge case defining a motion path inclined backwards for the shape memory material to follow when a temperature increase passes a temperature such that the shape memory struggles to resume a former shape, resulting in that the base plate is unlocked from the bottom section of the cartridge case and released.

* * * * *